United States Patent [19]

Suvitie et al.

[11] 3,987,515

[45] Oct. 26, 1976

[54] CURTAIN BOARD

[76] Inventors: Aimo Jarmo Juhani Suvitie; Seppo Juhani Suvitie, both of Sirkkalankatu 22 as 6-7, Turku, Finland

[22] Filed: Mar. 25, 1975

[21] Appl. No.: 561,902

[30] Foreign Application Priority Data

Mar. 29, 1974 Finland ..... 966/74

[52] U.S. Cl. ..... 16/94 D; 16/87.4 R; 16/95 R

[51] Int. Cl.[2] ..... A47H 15/00

[58] Field of Search ..... 16/95 D, 94 D, 96 D, 16/87.4 R, 95 R, 93 D; 160/345–347, 330

[56] References Cited

UNITED STATES PATENTS

| | | | |
|---|---|---|---|
| 3,699,610 | 10/1972 | Harby | 16/94 D |
| 3,818,544 | 6/1974 | Helmer | 16/93 D |
| 3,823,439 | 7/1974 | Selset | 16/95 D |

FOREIGN PATENTS OR APPLICATIONS

| | | | |
|---|---|---|---|
| 502,830 | 5/1951 | Belgium | 16/93 D |

*Primary Examiner*—Andrew V. Kundrat
*Attorney, Agent, or Firm*—Eugene J. Kalil; James M. Rhodes, Jr.

[57] ABSTRACT

A curtain board includes a base member having a planar portion which is mounted along a ceiling. A front portion extends outwardly and downwardly from this planar portion terminating in a front edge which is spaced from the ceiling. A curtain slide arrangement is mounted within and extends along the planar portion of the base member. A front board is attached to and extends downwardly from the front edge of the base member to mask the slide appartus. An extension projects outwardly and downwardly from the rear edge of the base member to cover irregularities which may be present in adjacent wall and ceiling surfaces. A vertical extension projects upwardly from the upper edge of the front board to mask irregularities in the adjacent ceiling surface.

5 Claims, 4 Drawing Figures

CURTAIN BOARD

BACKGROUND OF THE DISCLOSURE

This invention relates to a curtain board consisting of a bottom board, a slide system, and a front board.

When fitting a curtain board to the ceiling, it is often noted that the wall and the ceiling of the room are not quite straight, and this often causes difficulties in the fitting of the curtain board to the ceiling. In addition, after construction work, the line where the wall and the ceiling join is usually rough and must be cleaned before fitting a prior art curtain board to the ceiling.

In curtain board according to this invention the rear edge of the base member is provided with an extension. This extension slopes downwardly from the ceiling so that its end is located lower than the surface of the ceiling when the curtain board is fitted to the ceiling. When the board is mounted this extension reaches substantially to the wall of the room. The extension may also be thinner than the remainder of the curtain board.

The shape of the curtain board made according to the invention is such that the board is easy to fit to the ceiling even if the ceiling and the wall of the room do not join on a straight line.

After construction work, the line where the wall and the ceiling join is often rough and requires cleaning, grinding and finishing if it is to remain showing. Aluminium rails which are presently in general use as curtain rails do not cover the line where the wall and the ceiling join, necessitating cleaning and finishing which causes additional costs. Using a curtain board according to this invention, eliminates the need for this finishing work as the extension on the rear of the base member covers any roughness in the ceiling and adjacent wall area.

When the upper part of the front board is provided with a vertical extension which may be thinner for ease of cutting a slight unevenness in the ceiling along the front edge of the curtain board is not apparent when the board is mounted on the ceiling.

DESCRIPTION OF THE PREFERRED EMBODIMENTS

A curtain board includes a base member 1 which is disposed along the ceiling of a room. Slide members 3 are mounted within and extend outwardly from the base member 1. A front board 2 extends downwardly from the sloping front portion 4 of the base member 1.

Figure 1:
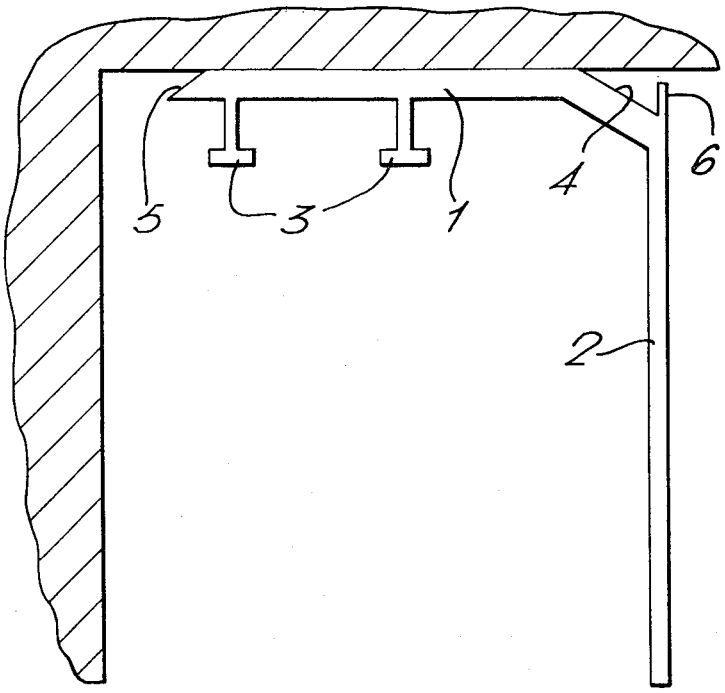
FIG. 1 shows a side elevational view of a first embodiment of the invention.
Figure 2:
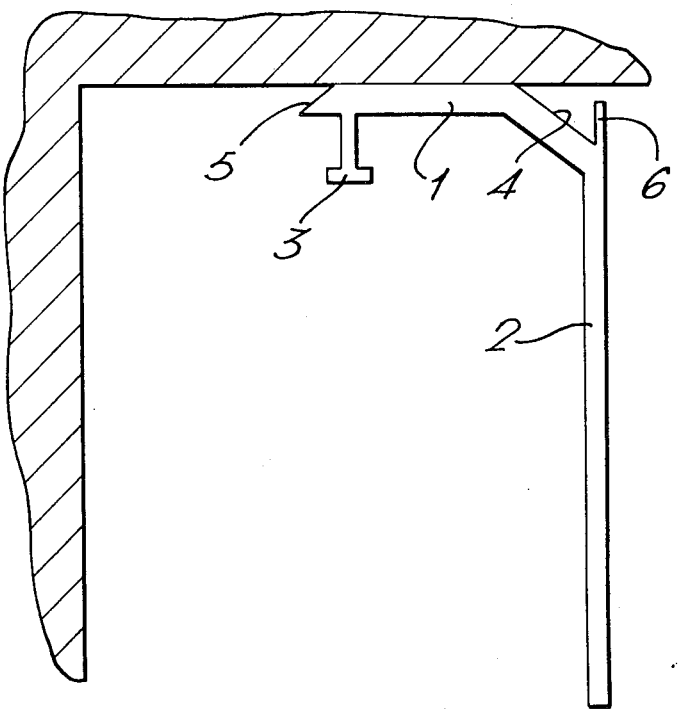
FIG. 2 shows a side elevational wiew of the embodiment of FIG. 1 including only one rail.

FIG. 1 shows a first embodiment of the curtain board with two rails, and FIG. 2 shows this embodiment with one rail. The upper surface of the front and rear edges 4, 5 of the base member 1 of the curtain rail are slanted. A vertical extension 6 extends upwardly from the upper edge of the front board 2. The vertical extension 6 is preferably thinner than the front board 2, and extends above the point where the slanted front edge 4 of base member 1 meets front board 2. If it happens that the ceiling of the room is not quite straight, part of the vertical extension 6 can be cut off, if necessary. It is also preferable that the vertical extension 6 does not extend to the same height as the upper surface of the base member 1 so that a gap is left between extension 6 and the ceiling. Due to this narrow gap, slight irregularities in the ceiling are not observed by eye as easily as when the front board extends right up to the ceiling since then small gaps would appear here and there between the ceiling and the front board.

Figure 3:
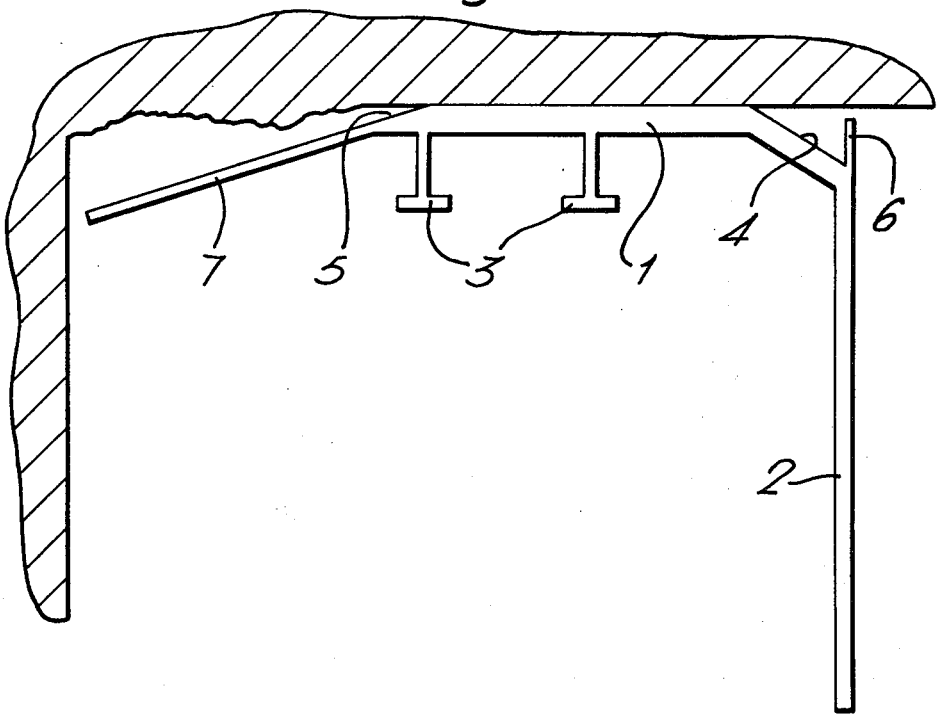
FIG. 3 shows a side elevational view of a second embodiment of the invention.
Figure 4:
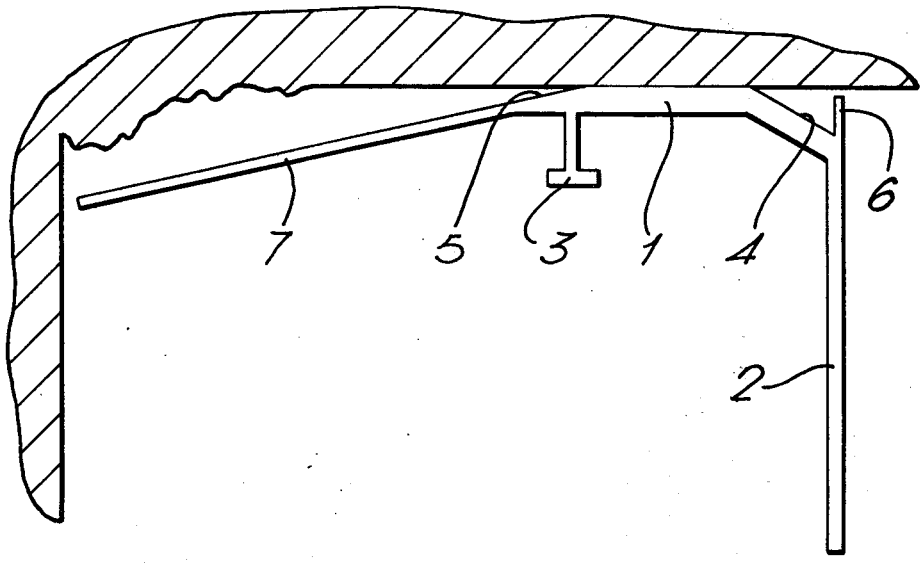
FIG. 4 show a side elevational view of the embodiment of FIG. 3 including only one rail.

FIGS. 3 and 4 show a second embodiment of the invention with FIG. 3 showing an alternative with two rails, and FIG. 4 showing the same embodiment with one rail. The slanted rear edge 5 of the base member is provided with a rear extension 7 which extends outwardly and downwardly from board 1 substantially to the wall of the room. The rear extension 7 covers the unfinished rough surface which may possibly exist along the line where the wall and the ceiling join. Since the upper surface of the rear extension 7 is lower than the upper surface of the base member 1, this roughness does not obstruct the fitting of the board. If irregularities of the wall surface so require, a portion can also be cut off the rear extension 7 when fitting the board to the ceiling.

A curtain board according to the invention is preferably manufactured of some flexible material, such as plastic. The board can then be bent to some extent according to the irregularities of the surfaces of the wall and the ceiling, and the rear extension of the base member 1 and top extension 6 of the front board 2 are easy to cut in case the unevenness of the wall or ceiling surfaces so require.

We claim:

1. A curtain board adopted for mounting along the ceiling of a room including:

an elongated base member having a substantially planar portion adapted to be disposed horizontally along said ceiling and having front and rear longitudinal edges, said base member having an elongated front portion extending outwardly and downwardly from said planar portion so that said front edge of said base member is spaced from said ceiling;

slide means mounted within and extending along said base member;

a first substantially vertically disposed member attached to and extending downwardly from said front edge of said base member;

an elongated extension projecting outwardly and sloping downwardly from said rear edge of said base member so that the outer edge of said extension is spaced from said ceiling; and a second substantially vertically oriented member extending upwardly from the top of said first vertically oriented member.

2. A curtain board as claimed in claim 1, in which the upper end of said second vertical member is spaced from said ceiling.

3. A curtain board as claimed in claim 1 in which said second vertical member is smaller in cross sectional area than said first vertical member.

4. A curtain board as claimed in claim 1 in which said elongated extension is smaller in cross sectional area than said base member.

5. A curtain board as claimed in claim 1 made of a flexible material.

* * * * *